US010118401B2

(12) United States Patent
Kimura et al.

(10) Patent No.: US 10,118,401 B2
(45) Date of Patent: Nov. 6, 2018

(54) LIQUID SUPPLY APPARATUS, LIQUID EJECTION APPARATUS

(71) Applicant: SEIKO EPSON CORPORATION, Tokyo (JP)

(72) Inventors: Naomi Kimura, Okaya (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/426,644

(22) Filed: Feb. 7, 2017

(65) Prior Publication Data

US 2017/0225478 A1 Aug. 10, 2017

(30) Foreign Application Priority Data

Feb. 9, 2016 (JP) ..... 2016-022784

(51) Int. Cl.
*B41J 2/175* (2006.01)
*B41J 29/02* (2006.01)
*B41J 29/13* (2006.01)

(52) U.S. Cl.
CPC ..... *B41J 2/17553* (2013.01); *B41J 2/1752* (2013.01); *B41J 2/17506* (2013.01); *B41J 2/17513* (2013.01); *B41J 29/02* (2013.01); *B41J 29/13* (2013.01)

(58) Field of Classification Search
CPC ..... B41J 2/17553; B41J 2/17506; B41J 2/17513; B41J 2/1752
See application file for complete search history.

(56) References Cited

U.S. PATENT DOCUMENTS

2016/0009100 A1* 1/2016 Kudo ..... B41J 2/17553 347/92

FOREIGN PATENT DOCUMENTS

JP 2011-240707 A 12/2011

* cited by examiner

*Primary Examiner* — Jason Uhlenhake
(74) *Attorney, Agent, or Firm* — Foley & Lardner LLP

(57) ABSTRACT

Provided is a liquid supply apparatus and a liquid ejection apparatus according to which liquid injected through a liquid injection portion can be supplied stably. The liquid supply apparatus includes: a liquid containing chamber capable of containing a liquid to be supplied to a liquid ejection portion; an air chamber in communication with the atmosphere; a communication path that allows an air introduction port for introducing air into the liquid containing chamber and an air chamber to be in communication, and a liquid injection portion through which the liquid can be injected into the liquid containing chamber. The liquid containing chamber is fixed such that the air introduction port is located at a bottom portion of the liquid containing chamber. The volume of the communication path is smaller than the volume of the air chamber. The uppermost portion of the communication path is located above the uppermost portion of the liquid containing chamber.

12 Claims, 5 Drawing Sheets

LIQUID SUPPLY APPARATUS, LIQUID EJECTION APPARATUS

BACKGROUND

1. Technical Field

The present invention relates to a liquid supply apparatus that supplies a liquid such as ink, and a liquid ejection apparatus such as an inkjet printer that ejects a liquid supplied from a liquid supply apparatus.

2. Related Art

There has been known to be a liquid ejection system (liquid ejection apparatus) including an ink tank (liquid supply apparatus) in which a liquid injection path (liquid injection portion) for injecting ink (a liquid) into a liquid containing chamber is formed (e.g., JP-A-2011-240707). The ink tank is provided such that its orientation can be changed. That is, ink is injected through the liquid injection path in an injection state in which the liquid injection path is open facing upward, and the ink tank supplies ink to a recording head (liquid ejecting portion) in a usage state in which the liquid injection path is open facing a horizontal direction.

Also, an air introduction port, which is one end of an air exposing flow path having another end that communicates with the atmosphere, is formed in the liquid containing chamber. The air introduction port is formed at a position located at a bottom portion when the ink tank is in the usage state, and a position located above the liquid surface of the ink when the ink tank is in the injection state. For this reason, when the ink tank into which the liquid was injected in the injection state is put in the usage state, an air contact liquid surface (meniscus) is formed near the air introduction port and a suitable hydraulic head difference is maintained between the ink tank and the recording head that ejects the ink.

JP-A-2011-240707 is an example of related art.

Incidentally, with this kind of ink tank, if ink is erroneously injected into the ink tank during the usage state, the ink will flow from the air introduction port to the air exposing flow path. Upon doing so, the principle of Mariotte's bottle cannot be used, the hydraulic head difference between the ink tank and the recording head will change, and thereby the supply of ink will become unstable.

Also, when ink flows into the air exposing flow path in this manner and an air contact liquid surface is formed at a position located away from the air introduction port, the air contact liquid surface cannot be returned to the vicinity of the air introduction port unless an amount of ink corresponding to the amount that flows into the air exposing flow path is supplied to the recording head.

Note that this problem is not limited to a liquid ejection system that ejects ink supplied from an ink tank that includes a liquid injection path, but is roughly the same for a liquid ejection apparatus that ejects liquid supplied from a liquid supply apparatus that includes a liquid injection portion.

SUMMARY

An advantage of some aspects of the invention is providing a liquid supply apparatus and a liquid ejection apparatus according to which liquid injected through a liquid injection portion can be supplied stably.

The following describes means for solving the above issues, and actions effects of such means.

A liquid supply apparatus that solves the foregoing problems is a liquid supply apparatus, including: a liquid containing chamber capable of containing a liquid to be supplied to a liquid ejection portion; an air chamber in communication with an atmosphere; a communication path that allows an air introduction port for introducing air into the liquid containing chamber, and the air chamber to communicate; and a liquid injection portion through which a liquid can be injected into the liquid containing chamber, wherein the liquid containing chamber is fixed such that the air introduction port is located at a bottom portion of the liquid containing chamber, the volume of the communication path is smaller than the volume of the air chamber, and an uppermost portion of the communication path is located higher than an uppermost portion of the liquid containing chamber.

According to this configuration, the air introduction port that communicates with the atmosphere via the communication path and the air chamber is located at the bottom portion of the liquid containing chamber, and therefore when the liquid is injected into the liquid containing chamber through the liquid injection portion, the liquid flows from the air introduction port to the communication path. Note that the uppermost portion of the communication path is located higher than the uppermost portion of the liquid containing chamber, and therefore the liquid that flows from the liquid introduction portion to the communication path stays in the communication path. Also, atmospheric pressure acts on the liquid surface of the liquid in the communication path communicating with the air chamber. For this reason, when the liquid is supplied from the sealed liquid containing chamber to the liquid ejection portion, the pressure acting on the liquid surface of the liquid in the communication path becomes greater than the pressure acting on the liquid surface of the liquid in the liquid containing chamber, and the liquid surface of the liquid in the communication path lowers before the liquid surface of the liquid in the liquid containing chamber does. In other words, the liquid is returned from the communication path to the liquid containing chamber according to the amount of liquid supplied from the liquid containing chamber. Also, because the volume of the communication path is smaller than the volume of the air chamber, the amount of the liquid that flows in the communication path is smaller than the amount of the liquid that flows from the air introduction port to the air chamber in the case where the air chamber and the liquid containing chamber directly communicate without using the communication path, for example. For this reason, the amount of liquid that needs to be supplied from the liquid containing chamber in order to cause the liquid surface to be located near the air introduction port is smaller, and it is possible to cause the liquid surface to be located near the air introduction port at an earlier time. Accordingly, the liquid injected through the liquid injection portion can be supplied stably.

In the liquid supply apparatus, it is preferable that the communication path is formed integrally with at least one of the liquid containing chamber and the air chamber.

According to this configuration, the liquid supply apparatus can be manufactured easily by integrally forming the communication path and at least one of the liquid containing chamber and the air chamber.

In the liquid supply apparatus, it is preferable that at least a portion of the communication path is constituted by a groove portion formed in a constituent member forming at least one of the liquid containing chamber and the air chamber, and a film sealing the groove portion.

According to this configuration, by forming at least a portion of the communication path with a groove portion formed in a constituent member and a film sealing the groove portion, the liquid supply apparatus can be more easily manufactured in comparison to the case of forming the entirety of the communication path in a pipe shape, for example.

In the liquid supply apparatus, it is preferable that at least a portion of the communication path is constituted by a communication pipe.

According to this configuration, even if the communication path is manufactured separately from the liquid containing chamber and is connected to the liquid containing chamber at a later time, for example, a portion of the communication path is constituted by a communication pipe, and therefore the liquid containing chamber and the communication path can be connected easily.

In the liquid supply apparatus, it is preferable that the air chamber is formed separately from the liquid containing chamber.

According to this configuration, since the air chamber and the liquid containing chamber are formed separately, it is possible to increase the degree of freedom in the shapes, capacities, arrangement, and the like of the air chamber and the liquid containing chamber.

Also, a liquid ejection apparatus that solves the foregoing problems is a liquid ejection apparatus including: the liquid supply apparatus with the above-described configuration; the liquid ejection portion configured to eject a liquid; and a supply portion configured to supply the liquid contained in the liquid containing portion to the liquid ejection portion.

According to this configuration, an effect similar to that achieved by the above-described liquid supply apparatus can be demonstrated.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejection apparatus including a liquid supply apparatus will be described with reference to the drawings. Note that the liquid ejection apparatus of the present embodiment is a printer that ejects ink, which is an example of a liquid, to a medium such as a sheet, and thereby prints (records) text, an image, or the like on the medium.

Figure 1:
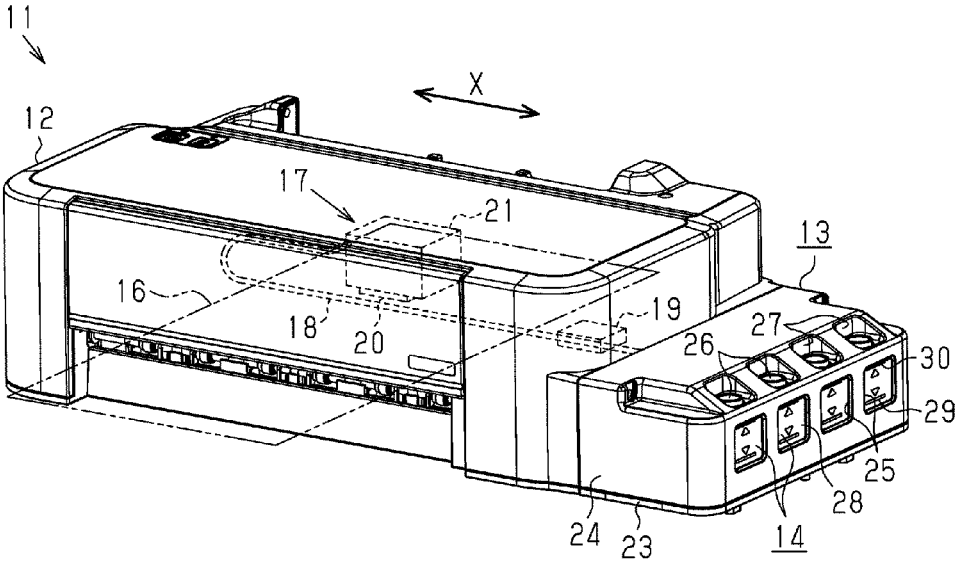
FIG. 1 is a perspective view of a first embodiment of a liquid ejection apparatus including a liquid supply apparatus.

As shown in FIG. 1, a liquid ejection apparatus 11 includes an apparatus body 12 that has an approximately cuboid shape, and a liquid supply unit 13 that is fixed to a side surface in the longitudinal direction of the apparatus body 12. The liquid supply unit 13 contains at least one (in the present embodiment, four) liquid supply apparatus 14. In other words, with the liquid ejection apparatus 11 of the present embodiment, liquid supply apparatuses 14 are attached to the outer side of a housing of the apparatus body 12.

The apparatus body 12 is provided with a printing portion 17 that performs printing by attaching a liquid to a medium 16, a supply portion 18 such as a tube that supplies the liquid from the liquid supply unit 13 to the printing portion 17, and a maintenance portion 19 for performing maintenance on the printing portion 17. Note that one supply portion 18 is connected to each liquid supply apparatus 14, but only one supply portion 18 is shown in FIG. 1 for the sake of simplicity in the drawing.

The printing portion 17 includes a liquid ejection portion 20 that ejects the liquid from a nozzle, and a carriage 21 that causes the liquid ejection portion 20 to move reciprocally along a scanning direction X that matches the longitudinal direction of the apparatus body 12. In other words, the printing portion 17 performs printing on the medium 16 by ejecting the liquid to the medium 16 from the liquid ejection portion 20, which moves reciprocally along the scanning direction X.

Figure 2:
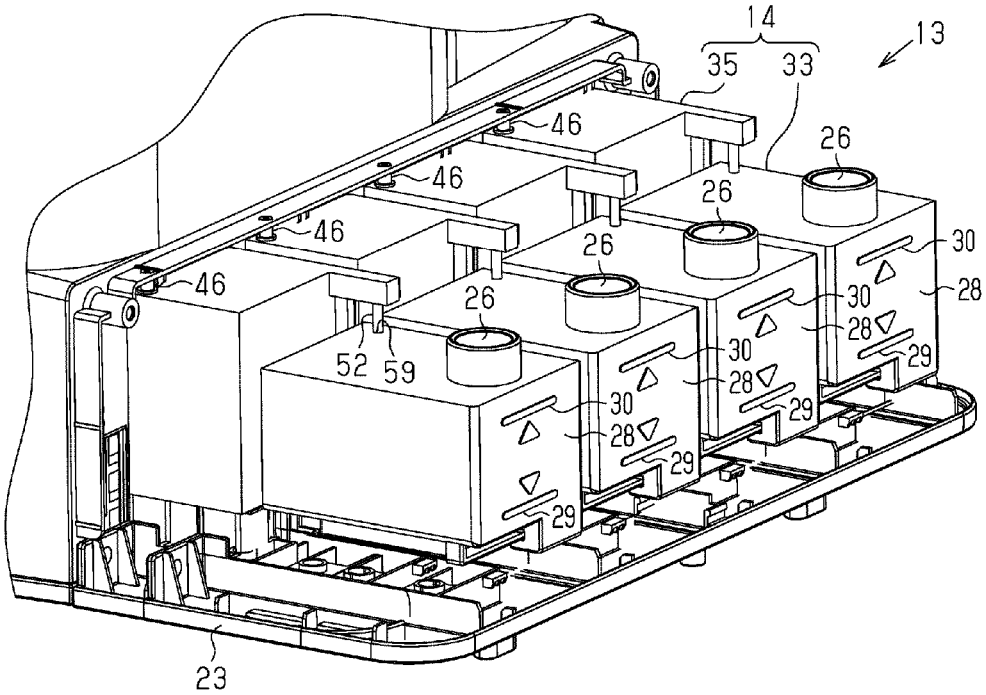
FIG. 2 is a perspective view of a liquid supply unit, showing a state in which a cover portion has been removed.

As shown in FIGS. 1 and 2, the liquid supply unit 13 includes a mounting portion 23 on which the liquid supply apparatuses 14 are mounted, and a cover portion 24 that covers the liquid supply apparatuses 14 mounted on the mounting portion 23. Also, a checking window portion 25 for checking the remaining amount of the liquid that can be supplied by the liquid supply apparatus 14, and an injection window portion 27 for causing liquid injection portions 26 included in the liquid supply apparatuses 14 to be exposed to the outside are formed in the cover portion 24.

Also, in each liquid supply apparatus 14, a region corresponding to the checking window portion 25 is used as a viewing surface 28 according to which the liquid injected through the liquid injection portion 26 can be viewed. Also, the viewing surface 28 is provided with a lower limit mark 29 indicating a lower limit amount serving as a reference for injecting the liquid into the liquid supply apparatus 14, and an upper limit mark 30 indicating an upper limit amount of the liquid injected into the liquid supply apparatus 14. Note that the lower limit mark 29 and the upper limit mark 30 of the present embodiment are formed so as to protrude from the viewing surface 28.

Next, the liquid supply apparatuses 14 will be described. Note that different types (e.g., four colors, namely cyan, magenta, yellow, and black) of liquid are injected into the respective liquid supply apparatuses 14, but the configurations thereof are the same. For this reason, one liquid supply apparatus 14 will be described, the same reference numerals will be used for each liquid supply apparatus 14, and redundant description will not be included.

Figure 3:
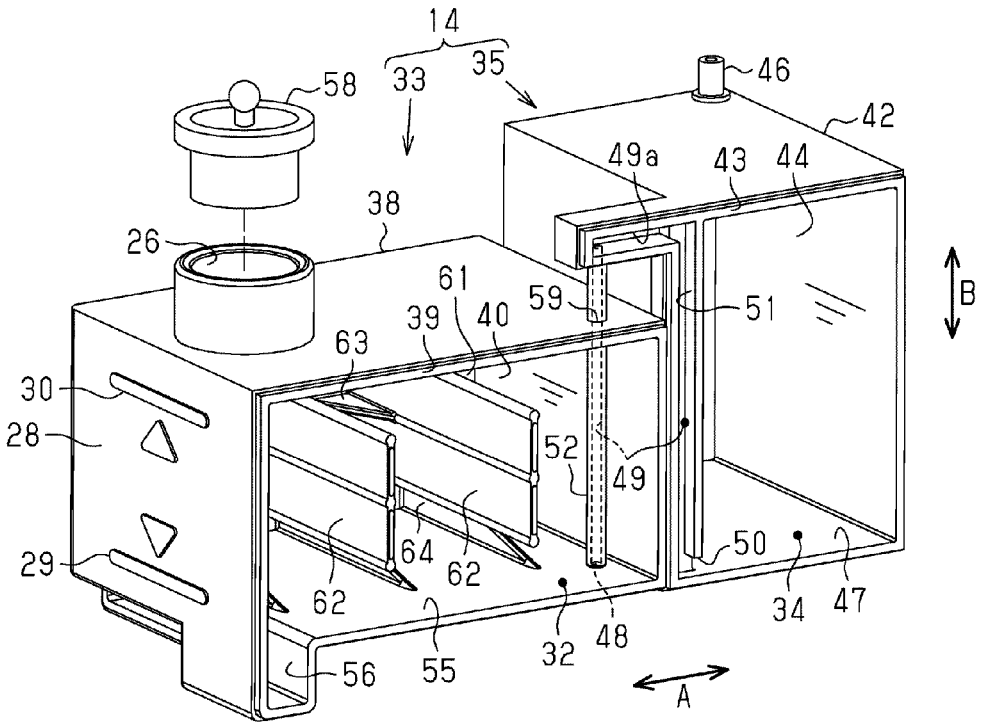
FIG. 3 is a perspective view of a liquid supply apparatus.

As shown in FIG. 3, the liquid supply apparatus 14 is constituted by a containing chamber forming body 33 that forms a liquid containing chamber 32 capable of containing the liquid to be supplied to the liquid ejection portion 20, and an air chamber forming body 35 that forms an air chamber 34. That is, the air chamber 34 is formed separately from the liquid containing chamber 32.

The containing chamber forming body 33 is made of transparent or translucent resin, and from the outer side of the containing chamber forming body 33, it is possible to view an intra-chamber liquid surface 36 (see FIG. 4), which is the liquid surface of the liquid contained in the liquid containing chamber 32. For this reason, when the liquid supply apparatus 14 is fixed in the liquid supply unit 13, the intra-chamber liquid surface 36 of the liquid contained in the liquid containing chamber 32 can be viewed from the outside via the checking window portion 25 of the cover portion 24.

The containing chamber forming body 33 is constituted by including a containing chamber case 38, which is an example of a constituent member forming the liquid containing chamber 32, and a containing chamber forming film 40 that covers a containing chamber opening 39 provided on one surface of the containing chamber case 38 in the form of a bottomed box. In other words, the containing chamber case 38 is obtained by integrally forming five surfaces, and the liquid containing chamber 32 is formed due to the containing chamber forming film 40 being attached to the containing chamber opening 39. Note that in the present embodiment, the containing chamber opening 39 has a rib shape formed on the entire periphery along the outer shape of the containing chamber case 38, and the containing chamber forming film 40 is welded to the containing chamber opening 39.

Also, the air chamber forming body 35 is constituted by including an air chamber case 42, which is an example of a constituent member forming the air chamber 34, and an air chamber forming film 44 that covers an air chamber opening 43 provided on one surface of the air chamber case 42 in the form of a bottomed box. In other words, the air chamber case 42 is obtained by integrally forming five surfaces, and the air chamber 34 is formed due to the air chamber forming film 44 being attached to the air chamber opening 43. Note that in the present embodiment, the air chamber opening 43 has a rib shape formed on the entire periphery along the outer shape of the air chamber case 42, and the air chamber forming film 44 is welded to the air chamber opening 43.

A tube-shaped air exposing portion 46 is formed in the air chamber 34, and the air chamber 34 always communicates with the atmosphere, regardless of the state of the liquid supply apparatus 14. That is, the air chamber 34 is maintained at atmospheric pressure even at a time of liquid injection, when the liquid is injected into the liquid containing chamber 32, and at a time of liquid supply, when the liquid is supplied from the liquid containing chamber 32, for example. Also, the communication path 49, which allows an air introduction port 48 for introducing air into the liquid containing chamber 32 and the air chamber 34 to communicate, is connected at a position in contact with an air chamber bottom surface 47 of the air chamber 34. That is, an air discharging port 50 for allowing air to be discharged from the air chamber 34 to the communication path 49 is formed in the air chamber 34.

The communication path 49 is partially constituted by the groove portion 51 formed in the air chamber case 42, and the air chamber forming film 44, which is an example of a film that seals the groove portion 51, and the communication path 49 is formed integrally with the air chamber 34. Furthermore, a communication pipe 52 is connected to the end portion of the groove portion 51 that is on the side opposite to the air discharging port 50. That is, at least a portion of the communication path 49 is constituted by the communication pipe 52, and the air introduction port 48 is considered to be the leading end of the communication pipe 52. Also, the length from the uppermost portion 49*a* of the communication path 49 to the air discharging port 50 is approximately the same as the length from the uppermost portion 49*a* of the communication path 49 to the air introduction port 48 (length of the communication pipe 52).

Figure 4:
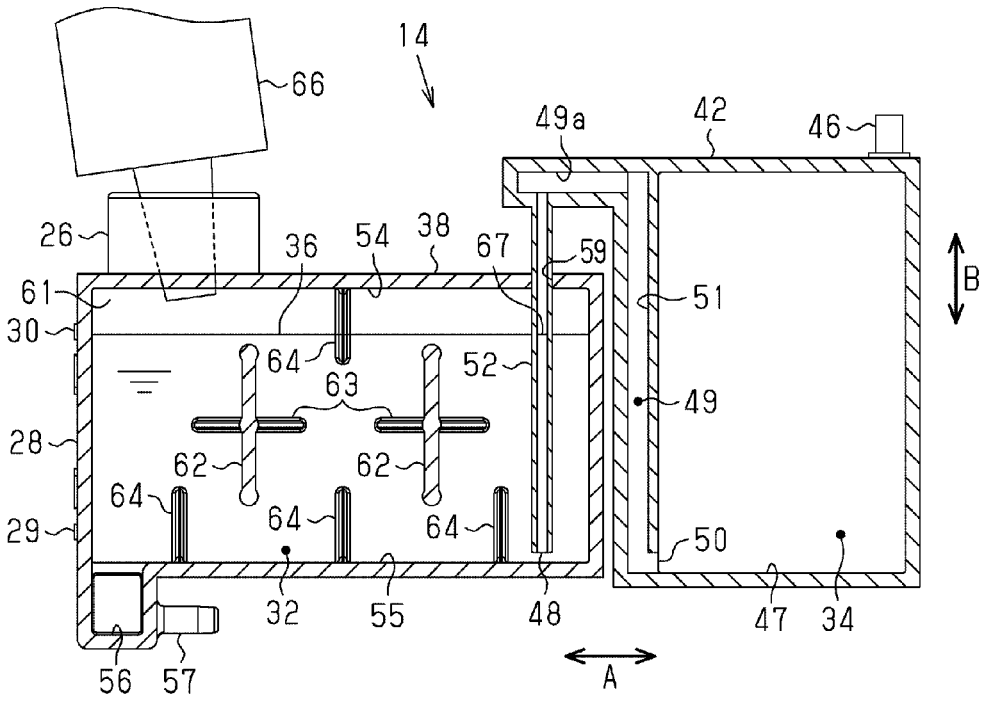
FIG. 4 is a cross-sectional view of a liquid supply apparatus into which a liquid is injected.

As shown in FIGS. 3 and 4, the volume of the communication path 49 is smaller than the volume of the air chamber 34, and is furthermore smaller than the volume of the liquid containing chamber 32. Also, in the state in which the liquid supply apparatus 14 is fixed in the liquid supply unit 13, the uppermost portion 49*a* of the communication path 49 in the vertical direction is located higher than the uppermost portion (in the present embodiment, a ceiling surface 54) of the liquid containing chamber 32. Note that the volume of the air chamber 34 of the present embodiment is smaller than the volume of the liquid containing chamber 32, but may be greater than or equal to the volume of the liquid containing chamber 32.

More specifically, the volume of the communication path 49 on the air introduction port 48 side with respect to the uppermost portion 49*a* is smaller than the volume of the liquid containing chamber 32 and is smaller than the volume of the air chamber 34. Furthermore, the cross-sectional area (flow path area) in the horizontal direction of the communication path 49 (in particular, on the air introduction port 48 side with respect to the uppermost portion 49*a*) is smaller than the cross-sectional area in the horizontal direction of the liquid containing chamber 32 and is smaller than the cross-sectional area in the horizontal direction of the air chamber 34. Also, the uppermost portion 49*a* of the communication path 49 of the present embodiment and the uppermost portion (in the present embodiment, the air exposing portion 46) of the air chamber 34 are located vertically higher than the leading end of the liquid introduction portion 26. Also, the liquid containing chamber 32 and the air chamber 34 are arranged laterally side-by-side such that the heights in the vertical direction of the containing chamber bottom surface 55 of the liquid containing chamber 32 and the air chamber bottom surface 47 are approximately the same, and the air introduction port 48 and the air discharging port 50 are located at approximately the same height in the vertical direction.

In the liquid containing chamber 32, a liquid-collecting recess 56 is formed so as to be open to the containing chamber bottom surface 55, and in the liquid-collecting recess 56, a liquid discharging portion 57 that discharges the liquid in the liquid containing chamber 32 is formed. In other words, the supply portion 18 included in the liquid ejection apparatus 11 is connected to the liquid discharging portion 57, and the supply portion 18 supplies the liquid contained in the liquid containing chamber 32 to the liquid ejection portion 20. Also, the liquid injection portion 26, through which the liquid can be injected into the liquid containing chamber 32, is open to the ceiling surface 54 of the liquid containing chamber 32 and is formed into a tube shape so as to protrude upward. Furthermore, a closing member 58 is detachably attached to the liquid injection portion 26. That is, the liquid containing chamber 32 is in an air-tight state due to the closing member 58 being attached to the liquid injection portion 26.

Furthermore, at the ceiling surface 54 of the liquid containing chamber 32, an insertion hole 59 into which the communication pipe 52 is inserted is formed at a position on the side opposite to the liquid-collecting recess 56 in the longitudinal direction (hereinafter referred to also as "front-rear direction A") of the containing chamber forming body 33. That is, the containing chamber forming body 33 and the air chamber forming body 35 are connected such that the communication pipe 52 is inserted through the insertion hole 59 and a gap exists between the air introduction port 48, which is the leading end of the communication pipe 52, and the containing chamber bottom surface 55.

Note that the gap between the insertion hole 59 and the communication pipe 52 is sealed in a state in which the communication pipe 52 has been inserted. Also, the liquid supply apparatus 14 is mounted in the liquid supply unit 13 such that the liquid injection portion 26 and the insertion hole 59 are located vertically higher than the containing chamber bottom surface 55. That is, the liquid containing chamber 32 is fixed such that the air introduction port 48 is located at the bottom portion of the liquid containing chamber 32. Note that the bottom portion of the liquid containing chamber 32 of the present embodiment is a portion located vertically below the horizontal plane including the lower limit mark 29, and is a portion located between the horizontal plane including the lower limit mark 29 and the containing chamber bottom surface 55.

In the liquid containing chamber 32, vertical rib portions 62, extended portions 63, and protruding portions 64 are formed integrally with the containing chamber case 38 so as to protrude from a far surface 61 that intersects the containing chamber bottom surface 55 and the ceiling surface 54. At least one (in the present embodiment, two) vertical rib portion 62 is formed so as to extend along a vertical direction B, which is a direction intersecting the containing chamber bottom surface 55 and the ceiling surface 54. Note that the vertical rib portions 62 are formed so as to be separated from the containing chamber bottom surface 55 and the ceiling surface 54. Also, the extended portions 63 are formed at positions on both sides in the front-rear direction A of the vertical rib portions 62, so as to form approximately triangular plate shapes such that the width in the front-rear direction A gradually increases from the containing chamber opening 39 side to the far surface 61 side. Also, at least one (in the present embodiment, four) protruding portion 64 is formed at a position between the vertical ribs 62 in the front-rear direction A so as to protrude from the containing chamber bottom surface 55 and the ceiling surface 54. Note that the protruding portions 64 each form an approximately triangular plate shape such that the width in the vertical direction B gradually decreases from the far surface 61 to the containing chamber opening 39 side.

Also, the width from a base end to a leading end of a vertical rib portion 62 is approximately equal to the width from the far surface 61 to the containing chamber opening 39. For this reason, when the containing chamber forming film 40 is attached to the containing chamber opening 39, the containing chamber forming film 40 is attached to the leading end surfaces of the vertical rib portions 62 as well. That is, the liquid containing chamber 32 is partitioned by the vertical rib portions 62, and the regions partitioned by the vertical rib portions 62 are in communication via the gaps between the vertical rib portions 62 and the containing chamber bottom surface 55 and the gaps between the vertical rib portions 62 and the ceiling surface 54.

Next, an effect in the case of injecting the liquid into the liquid containing chamber 32 and supplying the liquid from the liquid supply apparatus 14 to the liquid ejection portion 20 will be described.

As shown in FIG. 4, when the liquid is to be injected (replenished) into the liquid containing chamber 32, a bottle 66 containing the liquid to be injected is inserted into the liquid injection portion 26 from which the closing member 58 has been removed, and the liquid is injected into the liquid containing chamber 32 from the bottle 66. Note that since the air introduction port 48 that communicates with the atmosphere is located at the bottom portion of the liquid containing chamber 32, the liquid injected into the liquid containing chamber 32 flows from the air introduction port 48 into the communication path 49. Also, the position in the vertical direction of an intra-path liquid surface 67, which is the liquid surface in the communication path 49 at this time, is approximately the same as the position of the intra-chamber liquid surface 36 in the liquid containing chamber 32.

Note that the uppermost portion 49*a* of the communication path 49 is located vertically higher than the upper limit mark 30 and the ceiling surface 54, which is the uppermost portion of liquid containing chamber 32, and therefore the liquid that flows into the communication path 49 through the air introduction port 48 stays in the communication path 49.

Figure 5:
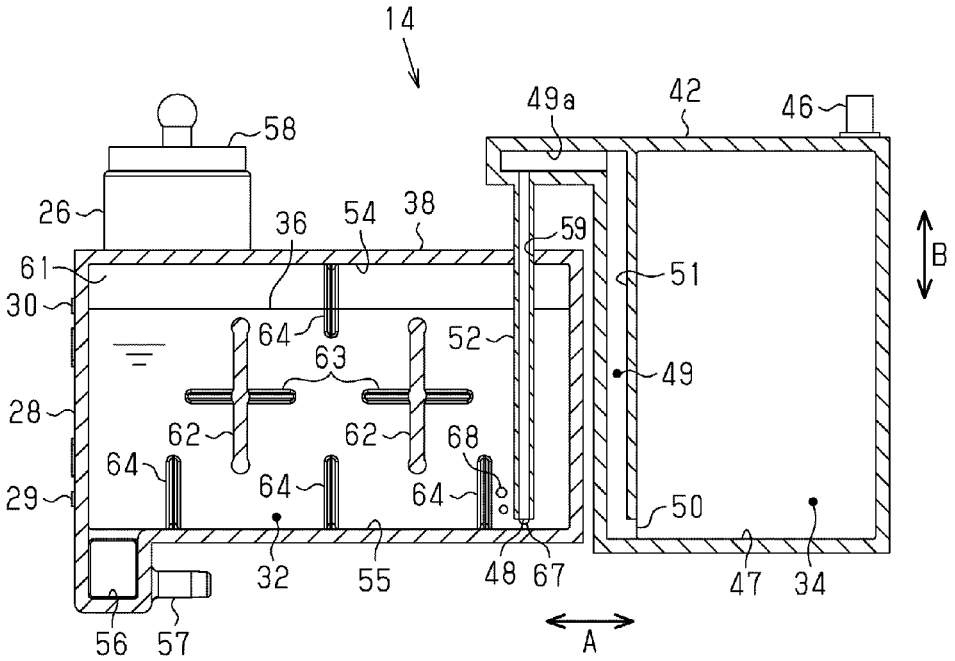
FIG. 5 is a cross-sectional view of a liquid supply apparatus supplying a liquid.

As shown in FIG. 5, when the liquid injection portion 26 is closed by the closing member 58, the interior of the liquid containing chamber 32 enters an air-tight state. Then, a maintenance portion 19 of the liquid ejection apparatus 11 performs maintenance on the liquid ejection portion 20. Specifically, the maintenance portion 19 performs cleaning in which liquid is forcibly discharged from the liquid ejection portion 20. At this time, the maintenance portion 19 causes liquid with a volume larger than the volume of the communication path 49 to be discharged from the liquid ejection portion 20. In other words, the maintenance portion 19 causes liquid of an amount greater than the amount of liquid that flowed into the communication path 49 through the air introduction port 48 to be discharged from the liquid ejection portion 20.

Then, when the liquid is discharged from the liquid ejection portion 20, liquid with a volume corresponding to the volume that was discharged is supplied from the liquid supply apparatus 14 to the liquid ejection portion 20. That is, the liquid supply apparatus 14 discharges the liquid in the liquid containing chamber 32 from the liquid discharging portion 57. Upon doing so, in the liquid containing chamber 32 in the air-tight state, the intra-chamber liquid surface 36 drops, the air in the liquid containing chamber 32 expands, and the pressure acting on the intra-chamber liquid surface 36 becomes a negative pressure. On the other hand, since the communication path 49 communicates with the air chamber 34, the atmospheric pressure acts on the intra-path liquid surface 67.

Accordingly, the pressure acting on the intra-chamber liquid surface 36 becomes smaller than the pressure acting on the intra-path liquid surface 67, and therefore the liquid flows out from the communication path 49 to the liquid containing chamber 32 due to the differential pressure. Note that in the maintenance, liquid with a volume larger than the volume of the communication path 49 is discharged, and therefore the intra-path liquid surface 67 moves to the vicinity of the air introduction port 48.

Then, when the liquid in the liquid containing chamber 32 is furthermore supplied to the liquid ejection portion 20 accompanying printing on the medium 16, air (air bubbles 68) is introduced through the air introduction port 48. For this reason, the liquid in the liquid containing chamber 32 is stably supplied to the liquid ejection portion 20 using the principle of Mariotte's bottle.

According to the above-described first embodiment, the following effects can be obtained.

(1) Since the air introduction port 48 that communicates with the atmosphere via the communication path 49 and the air chamber 34 is located at the bottom portion of the liquid containing chamber 32, when the liquid is injected into the liquid containing chamber 32 through the liquid injection portion 26, the liquid flows into the communication path 49 through the air introduction port 48. Also, the uppermost portion 49*a* of the communication path 49 is located higher than the uppermost portion of the liquid containing chamber 32, and therefore the liquid that flows into the communication path 49 through the air introduction port 48 stays in the communication path 49. Also, the atmospheric pressure acts on the liquid surface of the liquid in the communication path 49 that communicates with the air chamber 34. For this reason, when the liquid is supplied from the sealed liquid containing chamber 32 to the liquid ejection portion 20, the pressure acting on the liquid surface of the liquid in the communication path 49 becomes greater than the pressure acting on the intra-chamber liquid surface 36 of the liquid in the liquid containing chamber 32, and the intra-path liquid surface 67 of the liquid in the communication path 49 drops before the intra-chamber liquid surface 36 of the liquid in the liquid containing chamber 32 does. In other words, the liquid is returned from the communication path 49 to the liquid containing chamber 32 according to the amount of liquid supplied from the liquid containing chamber 32. Also, since the volume of the communication path 49 is smaller than the volume of the air chamber 34, the amount of liquid that flows into the communication path 49 is less than the amount of liquid that flows into the air chamber 34 through the air introduction port 48 in the case where the air chamber 34 and the liquid containing chamber 32 are allowed to directly communicate without using the communication path 49, for example. For this reason, the amount of liquid that needs to be supplied from the liquid containing chamber 32 in order to cause the intra-path liquid surface 67 to be located near the air introduction port 48 also decreases, and it is possible to cause the intra-path liquid surface 67 to be located near the air introduction port 48 at an earlier time. Accordingly, the liquid injected through the liquid injection portion 26 can be supplied stably.

(2) Due to the communication path 49 being formed integrally with the air chamber 34, the liquid supply apparatus 14 can be easily manufactured.

(3) Due to at least a portion of the communication path 49 being constituted by the groove portion 51 formed in the air chamber case 42 and the air chamber forming film 44 sealing the groove portion 51, the liquid supply apparatus 14 can be manufactured more easily compared to the case of forming the entirety of the communication path 49 into a tube shape, for example.

(4) Even in the case where the communication path 49 is manufactured separately from the liquid containing chamber 32 and is connected to the liquid containing chamber 32 at a later time, the liquid containing chamber 32 and the communication path 49 can be connected easily since a portion of the communication path 49 is constituted by the communication pipe 52.

(5) Since the air chamber 34 is formed separately from the liquid containing chamber 32, it is possible to increase the degree of freedom in the shapes, volumes, arrangement, and the like of the air chamber 34 and the liquid containing chamber 32.

(6) After the liquid is injected into the liquid containing chamber 32, the maintenance portion 19 performs maintenance on the liquid ejection portion 20. For this reason, the intra-path liquid surface 67 can be brought close to the air introduction port 48 before printing is performed on the medium 16. Accordingly, the supplying of the liquid accompanying the printing on the medium 16 can be stabilized at an earlier time compared to the case of performing printing without performing maintenance.

(7) After the liquid is injected into the liquid containing chamber 32 through the liquid injection portion 26, the maintenance unit 19 causes liquid with a volume greater than the volume of the communication path 49 to be discharged from the liquid ejection portion 20. For this reason, the intra-path liquid surface 67 can be moved near the air introduction port 48 through maintenance. Accordingly, when the liquid ejection portion 20 performs printing on the medium thereafter, the liquid can be supplied stably from the liquid discharging portion 57 to the liquid ejection portion 20.

(8) For example, if the temperature of the location at which the liquid ejection apparatus 11 is installed changes, the air in the liquid containing chamber 32 expands or contracts and the pressure acting on the intra-chamber liquid surface 36 changes in some cases. That is, when a large amount of pressure (positive pressure) is applied to the intra-chamber liquid surface 36 due to the atmospheric pressure, there is a risk that the liquid will flow out from the liquid containing chamber 32 via the air introduction port 48 and the communication path 49. In that respect, the communication path 49 is connected to the air chamber 34, and therefore the liquid that flows out from the liquid containing chamber 32 via the communication path 49 can be received by the air chamber 34. That is, it is possible to reduce the risk that the liquid will leak to the outside of the liquid supply apparatus 14. Furthermore, the air discharging port 50 is formed to as to be in contact with the air chamber bottom surface 47. For this reason, if the pressure in the liquid containing chamber 32 becomes negative accompanying a temperature change or the supply of liquid, the liquid received in the air chamber 34 can be returned to the liquid containing chamber 32 via the communication path 49.

(9) In the longitudinal direction (front-rear direction A) of the liquid containing chamber 32, the air introduction port 48 is formed on another end side, which is located on the side opposite to the end side on which the liquid discharging portion 57 is provided. For this reason, the liquid discharging portion 57 and the air introduction port 48 are formed at separate positions, and therefore it is possible to reduce the risk that air bubbles 68 introduced through the air introduction port 48 will be discharged through the liquid discharging portion 57.

(10) Since the lower limit mark 29 serving as a reference for injecting the liquid into the liquid containing chamber 32 is provided on the liquid supplying apparatus 14, when the intra-chamber liquid surface 36 of the liquid containing chamber 32 drops to the lower limit mark 29, the liquid is injected through the liquid injection portion 26. Also, since the air introduction port 48 is located vertically lower than the lower limit mark 29, the liquid in the liquid containing chamber 32 can be supplied stably.

(11) Since the uppermost portion 49*a* of the communication path 49 is located higher than the liquid injection portion 26, it is possible to reduce the risk that the liquid will flow into the air chamber 34 via the communication path 49, even if the liquid is injected through the liquid injection portion 26 and exceeds the upper limit mark 30, for example.

(12) For example, when pressure is applied to the liquid in the liquid containing chamber 32 to supply the liquid, air tends to dissolve into the liquid. In that respect, the pressure in the liquid containing chamber 32 is maintained at the atmospheric pressure or a negative pressure accompanying the supplying of the liquid from the liquid containing chamber 32 to the liquid ejection portion 20. For this reason, the amount of air that dissolves in the liquid can be reduced compared to the case of supplying the liquid by applying pressure.

Second Embodiment

Next, a second embodiment of a multi-function printer including a liquid supply apparatus and a liquid ejection apparatus will be described with reference to the drawings. Note that the shape of the liquid supply apparatus in the second embodiment differs from that of the first embodiment. Also, since the second embodiment is approximately the same as the first embodiment in other respects, identical configurations are denoted by identical reference numerals, and redundant description thereof is not included.

Figure 6:
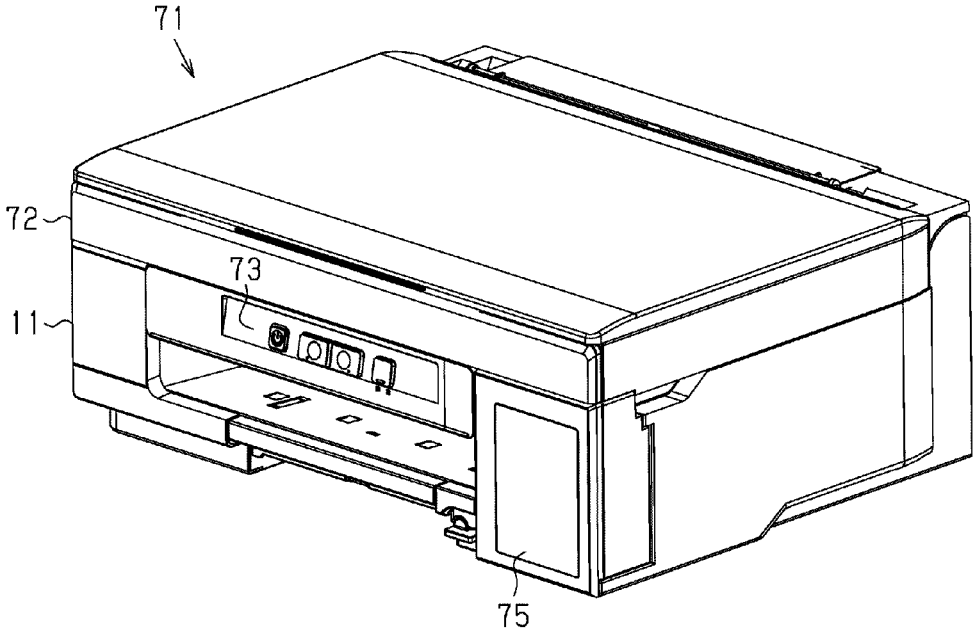
FIG. 6 is a perspective view of a second embodiment of a multi-function printer including a liquid supply apparatus and a liquid ejection apparatus.

As shown in FIG. 6, a multi-function printer 71 includes a liquid ejection apparatus 11 and an image reading apparatus 72 arranged on the liquid ejection apparatus 11, and the multi-function printer 71 has an approximately cuboid shape overall. Also, operation portions 73 such as buttons for performing various operations on the multi-function printer 71 are provided on one end side (front surface side) of the liquid ejection apparatus 11. Also, the image reading apparatus 72 is attached via a rotation mechanism (not shown) such as a hinge provided on the other end side (rear surface side), which is opposite to the one end side on which the operation portions 73 are provided. That is, the image reading apparatus 72 is provided on the liquid ejection apparatus 11 so as to be able to open and close by rotating using the other end side as a fulcrum.

Figure 7:
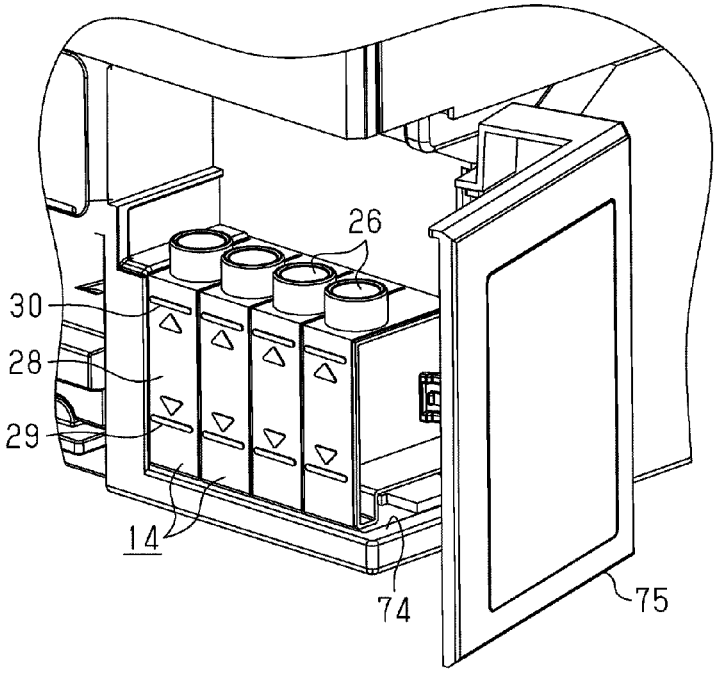
FIG. 7 is a perspective view of liquid supply apparatuses fixed to a fixing portion.

As shown in FIGS. 6 and 7, a fixing portion 74 at which at least one (in the present embodiment, four) liquid supply apparatus 14 is fixed and a cover 75 covering the fixing portion 74 are provided on the front surface side of the liquid ejection apparatus 11. In other words, with the liquid ejection apparatus 11 of the present embodiment, liquid supply apparatuses 14 are equipped in a housing of the liquid ejection apparatus 11.

As shown in FIG. 7, the liquid supply apparatuses 14 are fixed to the fixing portion 74 such that the liquid injection portions 26 and the viewing surfaces 28 are located on the front surface side of the liquid ejection apparatus 11, and such that the liquid injection portions 26 are located vertically higher than the viewing surfaces 28. Note that the cover 75 is provided so as to be able to open and close by rotating centered about a shaft (not shown). That is, the cover 75 covers the liquid supply apparatuses 14 fixed to the fixing portion 74 due to being located at a closed position shown in FIG. 6, and the cover 75 exposes the liquid injection portions 26 and the viewing surfaces 28 of the liquid supply apparatuses 14 due to being located at an open position shown in FIG. 7.

Next, the liquid supply apparatuses 14 will be described.

Figure 8:
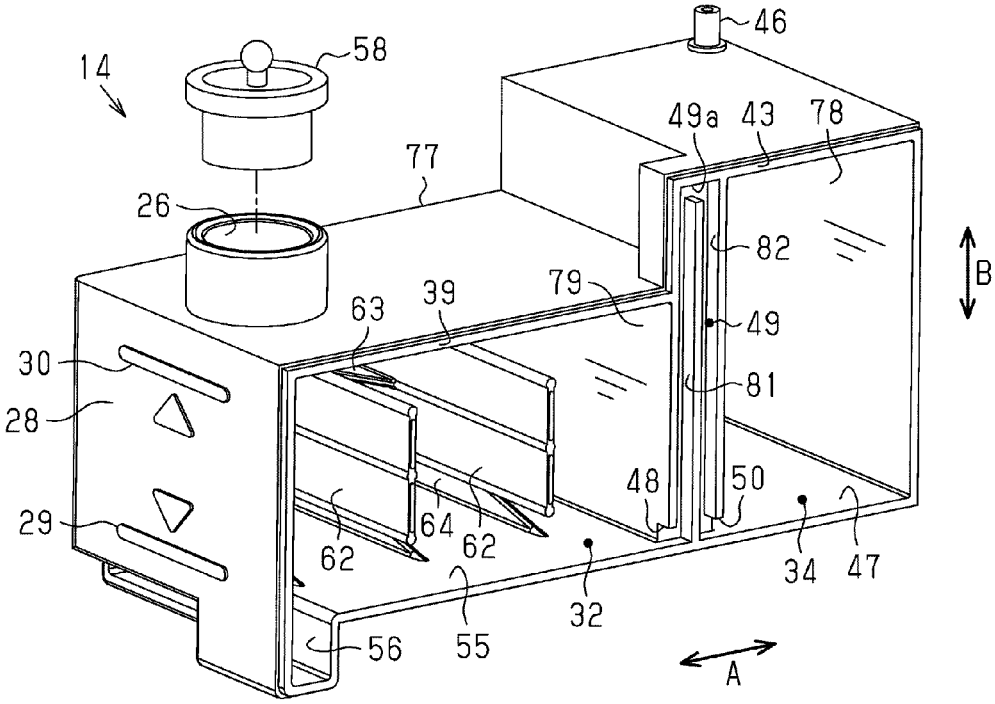
FIG. 8 is a perspective view of a liquid supply apparatus.

As shown in FIG. 8, the liquid supply apparatus 14 is constituted by including a containing body case 77 in the form of a bottomed box, which is an example of a constituent member forming the liquid containing chamber 32 and the air chamber 34, and a containing body forming film 78. The containing body case 77 is obtained by integrally forming five surfaces, and a containing chamber opening 39 and an air chamber opening 43 are formed therein. Also, the liquid containing chamber 32 and the air chamber 34 are formed due to the containing body forming film 78 being attached to the containing chamber opening 39 and the air chamber opening 43. That is, the air chamber 34 is formed integrally with the liquid containing chamber 32.

Note that the liquid containing chamber 32 and the air chamber 34 are partitioned into a region serving as the air chamber 34 and a region serving as the liquid containing chamber 32 by a partitioning wall 79 formed so as to extend along the vertical direction B. Also, a first groove portion 81, one end of which is used as the air introduction portion 48 that is open so as to be in contact with the containing chamber bottom surface 55 of the liquid containing chamber 32, and a second groove portion 82, one end of which is used as the air discharging port 50 that is open so as to be in contact with the air chamber bottom surface 47 of the air chamber 34, are formed in the partitioning wall 79. Also, the other ends of the first groove portion 81 and the second groove portion 82 are in communication, and the first groove portion 81 and the second groove portion 82 are sealed by the containing body forming film 78.

In other words, the communication path 49 is constituted by the first groove portion 81 and the second groove portion 82 formed in the containing body case 77, which is an example of a constituent member forming the liquid containing chamber 32 and the air chamber 34, and by the containing body forming film 78, which is an example of a film that seals the first groove portion 81 and the second groove portion 82. Also, the liquid supply apparatus 14 is fixed to the fixing portion 74 such that the uppermost portion 49*a* of the communication path 49 obtained by connecting the first groove portion 81 and the second groove portion 82 is higher than the uppermost portion of the liquid containing chamber 32, and such that the air introduction port 48 is located at the bottom portion of the liquid containing chamber 32.

Also, when the containing body forming film 78 is attached to the containing chamber opening 39 and the air chamber opening 43, the containing body forming film 78 is similarly attached by adhesion, welding, or the like to the vertical rib portion 62 and the partitioning wall 79 as well.

Figure 9:
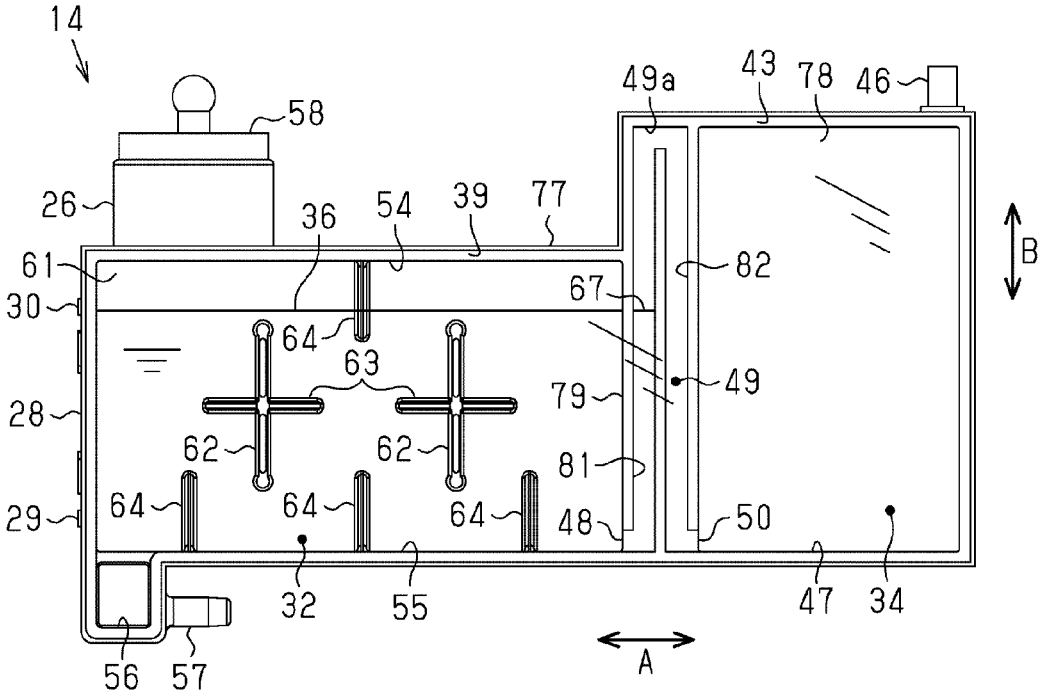
FIG. 9 is a side view of a liquid supply apparatus in a view from an opening side thereof.

Also, the containing body case 77 is made of transparent or translucent resin, and from the outer side of the liquid supply apparatus 14, it is possible to view the liquid contained in the liquid containing chamber 32, and an intra-chamber liquid surface 36 (see FIG. 9).

Next, an effect in the case of injecting the liquid into the liquid containing chamber 32 and supplying the liquid from the liquid supply apparatus 14 to the liquid ejection portion 20 will be described.

As shown in FIG. 7, the cover 75 is located in the open position when the liquid is to be injected into the liquid containing chamber 32. Also, since the image reading apparatus 72 is located above the liquid injection portions 26, the image reading apparatus 72 is rotated to an open position with respect to the liquid ejection apparatus 11. Upon doing so, a space is formed above the liquid injection portions 26.

Then, as shown in FIG. 9, the liquid containing chamber 32 is injected through the liquid injection portion 26 and the liquid injection portion 26 is closed with the closing member 58. Upon doing so, the fluid flows into the communication path 49 through the air introduction port 48, similarly to the first embodiment, and the intra-chamber liquid surface 36 and the intra-path liquid surface 67 are at approximately the same position in the vertical direction.

Then, when the liquid is discharged from the liquid discharging portion 57 accompanying the maintenance performed by the maintenance portion 19 or printing, the pressure acting on the intra-chamber liquid surface 36 becomes smaller than the atmospheric pressure acting on the intra-path liquid surface 67, and therefore the liquid flows out from the communication path 49 to the liquid communication chamber 32 due to the differential pressure. That is, when the intra-path liquid surface 67 moves near the air introduction port 48 and the liquid in the liquid communication chamber 32 is furthermore supplied to the liquid ejection portion 20, air is introduced through the air introduction port 48. For this reason, the liquid in the liquid containing chamber 32 is stably supplied to the liquid ejection portion 20 using the principle of Mariotte's bottle.

According to the above-described second embodiment, the following effects can be obtained in addition to the effects (1) to (12) of the above-described first embodiment.

(13) The liquid supply apparatus 14 can be manufactured easily by forming the communication path 49 integrally with the liquid containing chamber 32 and the air chamber 34.

(14) Due to the communication path 49 being constituted by the first groove portion 81 and the second groove portion 82 formed in the containing body case 77, and by the containing body forming film 78 that seals the first groove portion 81 and the second groove portion 82, the liquid supply apparatus 14 can be manufactured more easily compared to the case of forming the communication path 49 into a pipe shape, for example.

Note that the above-described embodiments may be modified as follows.

In the above-described embodiments, it is possible to use a configuration in which at least one of the lower limit mark 29 and the upper limit mark 30 is not provided.

In the above-described embodiments, it is possible to include a detection unit that detects a remaining amount of liquid contained in the liquid containing chamber 32 and a reporting unit that performs reporting in the case where the remaining amount detected by the detection unit is less than or equal to a threshold value serving as a reference for injecting the liquid into the liquid containing chamber 32. Also, the bottom portion of the liquid containing chamber 32 may be the position that is vertically below the intra-chamber liquid surface 36 in the case where the remaining amount of the liquid and the threshold value are equal, for example.

In the above-described embodiments, the bottom portion of the liquid containing chamber 32 at which the air introduction port 48 is provided may be the portion vertically below the lower end of the vertical rib portion 62, for example. Also, the bottom portion of the liquid containing chamber 32 may be the uppermost portion of the protruding portion 64 protruding from the containing chamber bottom surface 55 or the portion vertically below the extended portion 63.

In the above-described embodiments, the air introduction port 48 may be formed so as to be open to the containing chamber bottom surface 55.

In the above-described embodiments, the maintenance of the liquid ejection portion 20 need not be performed after the liquid is injected through the liquid injection portion 26. That is, the intra-path liquid surface 67 of the liquid in the communication path 49 may be lowered due to the liquid ejection portion 20 performing printing on the medium 16.

In the above-described embodiments, the amount of the liquid discharged from the liquid ejection portion 20 after the liquid is injected through the liquid injection portion 26 may have a volume that is larger than the volume from the air introduction port 48 of the communication path 49 to the upper limit mark 30. Also, the amount of liquid to be discharged from the liquid ejection portion 20 is preferably greater than the volume from the air introduction port 48 of the communication path 49 to the uppermost portion 49*a*, and more preferably greater than the volume of the overall communication path 49. Also, the liquid ejection portion 20 may discharge the liquid using flushing, in which the liquid is ejected regardless of the printing on the medium 16.

In the above-described embodiments, a liquid supply unit 13 in which the liquid supply apparatus 14 or multiple liquid supply apparatuses 14 are arranged may be provided separately. That is, the liquid supply apparatuses 14 and the liquid supply unit 13 need not be fixed to the liquid ejection apparatus 11 or the multi-function printer 71.

In the above-described embodiments, the liquid containing chamber 32, the communication path 49, and the air chamber 34 may all be formed separately. For example, one end side of the communication pipe 52 forming the communication path 49 may be inserted into the insertion hole 59 and the other end side of the communication pipe 52 may be further connected to the air chamber 34. That is, the entirety of the communication path 49 may be constituted by the communication pipe 52. Also, the communication pipe 52 may be constituted by a rigid pipe, a flexible tube, or a combination thereof.

In the above-described embodiments, the communication path 49 may be formed integrally with the liquid containing chamber 32, and the air discharging port 50 may be connected to the air chamber 34. Also, the communication path 49 may be connected at any position in the air chamber 34.

In the above-described embodiments, the liquid ejection apparatus may be a liquid ejection apparatus that ejects or discharges a liquid other than ink. Note that examples of the state of the liquid discharged as very small droplets from the liquid ejection apparatus include a granular shape, a teardrop shape, and a shape having a thread-like trailing end. Also, a liquid in this context need only be a material that can be ejected from the liquid ejection apparatus. For example, it is sufficient to use a liquid in a state at a time when a substance is in the liquid phase, examples thereof including liquids with high or low viscosity, and fluids such as sols, gels, other inorganic solvents, organic solvents, solutions, liquid resins, and liquid metals (metallic melts). Examples also include not only liquids that are one-state substances, but also liquids that include particles of a functional material composed of solid matter such as pigment or metallic particles, that are dissolved, dispersed, or mixed in a solvent. Representative examples of liquids include ink, as described in the above-described embodiments, liquid crystal, and the like. Here, ink encompasses various types of liquid-phase components, such as common water-based ink and oil-based ink, as well as gel ink and hot-melt ink. Specific examples of liquid ejection apparatuses include liquid ejection apparatuses that eject liquids that include, in a dispersed or dissolved form, materials such as electrode materials and color materials used in the manufacture of liquid crystal displays, EL (electroluminescence) displays, planar light emitting displays, color filters, and the like, for example. The liquid ejection apparatus may also be a liquid ejection apparatus that ejects living organic matter used in the manufacture of biochips, a liquid ejection apparatus that is used as a precision pipette and ejects a liquid serving as a test sample, a printing apparatus, a microdispenser, or the like. Furthermore, the liquid ejection apparatus may also be a liquid ejection apparatus that ejects lubricant at a pinpoint in a precision machine such as a watch or a camera, or a liquid ejection apparatus that ejects, onto a substrate, a transparent resin liquid such as an ultra-violet curable resin in order to form a minute hemispherical lens (optical lens) to be used in an optical communication element or the like. Also, the liquid ejection apparatus may be a liquid ejection apparatus that ejects an acidic or alkaline etching solution in order to etch a substrate, or the like. Also, the liquid supply apparatus may be an apparatus that supplies a liquid to be ejected by these liquid ejection apparatuses.

CROSS REFERENCE TO RELATED APPLICATIONS

The present application claims priority from Japanese Patent Application No. 2016-022784 filed on Feb. 9, 2016, the contents of which are hereby incorporated by reference into this application.

What is claimed is:

1. A liquid supply apparatus, comprising:
a liquid containing chamber configured to contain a liquid to be supplied to a liquid ejection portion;
an air chamber in communication with an atmosphere;
a communication path that allows an air introduction port for introducing air into the liquid containing chamber, and the air chamber to communicate; and
a liquid injection portion through which a liquid can be injected into the liquid containing chamber,
wherein the liquid containing chamber is fixed such that the air introduction port is located at a bottom portion of the liquid containing chamber,
the air chamber is located next to the liquid chamber,
the volume of the communication path is smaller than the volume of the air chamber,
an uppermost portion of the communication path is located higher than an uppermost portion of the liquid containing chamber, and
the communication path comprises a first portion that extends vertically downwards into the liquid containing chamber, and a second portion that extends vertically downwards into the air chamber.

2. The liquid supply apparatus according to claim 1, wherein the communication path is formed integrally with at least one of the liquid containing chamber and the air chamber.

3. The liquid supply apparatus according to claim 2,
wherein at least a portion of the communication path is constituted by a groove portion formed in a constituent member forming at least one of the liquid containing chamber and the air chamber, and a film sealing the groove portion.

4. A liquid ejection apparatus comprising:
the liquid supply apparatus according to claim 3;
the liquid ejection portion configured to eject a liquid; and
a supply portion configured to supply the liquid contained in the liquid containing portion to the liquid ejection portion.

5. A liquid ejection apparatus comprising:
the liquid supply apparatus according to claim 2;
the liquid ejection portion configured to eject a liquid; and
a supply portion configured to supply the liquid contained in the liquid containing portion to the liquid ejection portion.

6. The liquid supply apparatus according to claim 1, wherein at least a portion of the communication path is constituted by a communication pipe.

7. A liquid ejection apparatus comprising:
the liquid supply apparatus according to claim 6;
the liquid ejection portion configured to eject a liquid; and
a supply portion configured to supply the liquid contained in the liquid containing portion to the liquid ejection portion.

8. The liquid supply apparatus according to claim 1, wherein the air chamber is formed separately from the liquid containing chamber.

9. A liquid ejection apparatus comprising:
the liquid supply apparatus according to claim 8;
the liquid ejection portion configured to eject a liquid; and
a supply portion configured to supply the liquid contained in the liquid containing portion to the liquid ejection portion.

10. A liquid ejection apparatus comprising:
the liquid supply apparatus according to claim 1;
the liquid ejection portion configured to eject a liquid; and
a supply portion configured to supply the liquid contained in the liquid containing portion to the liquid ejection portion.

11. A liquid supply apparatus, comprising:
a liquid containing chamber configured to contain a liquid to be supplied to a liquid ejection portion;
an air chamber in communication with an atmosphere;
a communication path that allows an air introduction port for introducing air into the liquid containing chamber, and the air chamber to communicate; and
a liquid injection portion through which a liquid can be injected into the liquid containing chamber, wherein:
the liquid containing chamber is fixed such that the air introduction port is located at a bottom portion of the liquid containing chamber,
the air chamber is located next to the liquid chamber,
the volume of the communication path is smaller than the volume of the air chamber,
an uppermost portion of the communication path is located higher than an uppermost portion of the liquid containing chamber, and
a bottom surface of the liquid containing chamber and a bottom surface of the liquid containing chamber are located at a same height.

12. A liquid supply apparatus, comprising:
a liquid containing chamber configured to contain a liquid to be supplied to a liquid ejection portion;
an air chamber in communication with an atmosphere;
a communication path that allows an air introduction port for introducing air into the liquid containing chamber, and the air chamber to communicate; and
a liquid injection portion through which a liquid can be injected into the liquid containing chamber, wherein:
the liquid containing chamber is fixed such that the air introduction port is located at a bottom portion of the liquid containing chamber,
the air chamber is located next to the liquid chamber,
the volume of the communication path is smaller than the volume of the air chamber,
an uppermost portion of the communication path is located higher than an uppermost portion of the liquid containing chamber, and
the uppermost portion of the communication path is located a distance from a first end of the communication path, and the uppermost portion of the communication path is located the same distance from a second end of the communication path.

* * * * *